United States Patent [19]

Forsyth et al.

[11] Patent Number: 5,048,730

[45] Date of Patent: Sep. 17, 1991

[54] MOISTURE-RESISTANT DISPENSING TOP

[75] Inventors: Michael J. Forsyth, Stow; Craig C. Wiedman, Brecksville, both of Ohio

[73] Assignee: Weatherchem Corporation, Twinsburg, Ohio

[21] Appl. No.: 521,389

[22] Filed: May 10, 1990

[51] Int. Cl.[5] ..... B67D 3/00

[52] U.S. Cl. ..... 222/482; 222/498; 222/556; 215/235

[58] Field of Search ..... 222/480, 481, 482, 498, 222/513, 517, 545, 556; 215/235, 236, 325, DIG. 1; 220/307, 354

[56] References Cited

U.S. PATENT DOCUMENTS

| | | | |
|---|---|---|---|
| 4,016,996 | 4/1977 | Aichinger et al. | 215/DIG. 1 X |
| 4,416,383 | 11/1983 | Frahm et al. | 215/DIG. 1 X |
| 4,629,081 | 12/1986 | McLaren | 215/235 X |
| 4,693,399 | 9/1987 | Hickman et al. | 222/480 |
| 4,881,688 | 11/1989 | Kitterman et al. | 222/498 X |
| 4,898,292 | 2/1990 | Ver Weyst et al. | 222/480 X |
| 4,936,494 | 6/1990 | Weidman | 222/480 |
| 4,955,513 | 9/1990 | Bennett | 222/480 |
| 4,962,869 | 10/1990 | Gross et al. | 222/556 X |
| 4,993,606 | 2/1991 | Bolen, Jr. et al. | 222/556 X |

FOREIGN PATENT DOCUMENTS

| | | | |
|---|---|---|---|
| 788148 | 12/1957 | United Kingdom | 215/DIG. 1 |

*Primary Examiner*—Michael S. Huppert
*Assistant Examiner*—Joseph A. Kaufman
*Attorney, Agent, or Firm*—Pearne, Gordon, McCoy & Granger

[57] ABSTRACT

A screw on container closure has a hinged flap on a dispensing aperture for spooning out product. The flap and aperture have a sealing flash structure that provides a moisture resistant seal therebetween. An integral resilient sealing flange within the closure provides a moisture-resistant seal on the mouth of a container.

11 Claims, 5 Drawing Sheets

MOISTURE-RESISTANT DISPENSING TOP

The invention relates to improvements in dispensing closures for containers and, in particular, to screw-on flap-type closures suitable for use with granular products.

PRIOR ART

Screw-on caps or closures with flap covered dispensing apertures are known from U.S. Pats. Nos. 3,675,821 and 4,693,399, for example. A desirable feature of the caps shown in these patents is a dispensing opening that is of generous size and allows convenient spooning out of products from containers on which they are mounted. In general, it has not been attempted to provide prior two-flap type screw-on caps with moisture-resistant capability. Aforementioned U.S. Pat. No. 3,675,812 illustrates a single-flap screw-on closure where the flap and dispensing opening have special provisions to achieve a tight seal. These special provisions require the wall of the closure opposed to a rib on the flap to be yieldable to produce a seal. Such an arrangement where a wall is necessarily yieldable may be overly sensitive to application torque and may pop open or otherwise malfunction when tightened onto a container.

SUMMARY OF THE INVENTION

The invention provides a screw-on dispensing cap for granular materials that affords improved moisture sealing capability at a hinged flap and at a container mouth seal. The cap is of the type useful with jars, bottles, and other containers having externally threaded necks and is compatible with paper, foil, and film barriers glued or otherwise applied across the mouth opening of the container to provide a freshness and/or tamper/indicating seal. The cap is especially suited for use with packaged goods that are moisture-sensitive and which because they are consumed over a relatively long period, require moisture-barrier capability in the closure after it has been first opened.

The disclosed cap, in accordance with the invention, has a geometrically simple and effective sealing flash structure that surrounds the dispensing aperture and forms a resilient flexed seal between the end wall forming the aperture and the flap. The sealing flash can be created on the cap without complicated tooling and readily tolerates variations in part size that are normally encountered in mass production molding processes. The geometry of the sealing flash also allows its sealing effectiveness to be generally independent of the torque level at which the cap is applied to a container since minor distortion of the cap end wall resulting from the application of expected torque levels does not significantly affect the orientation or configuration of the deployed flexed sealing flash.

The container mouth sealing area of the disclosed cap has a deflectable resilient flange that improves sealing performance and also is relatively insensitive to variations in cap tightening torque. The inherent resilience of the flange ensures that contact with the full periphery of the mouth of the container is obtained under low torque regardless of normal manufacturing variation in the shape of the container or cap and despite weak manual reinstallation of the cap. The resilience of the flange seal is particularly important where moisture-resistance is desirable after a freshness seal is removed by a user from the mouth of the container. Even where the freshness seal is imperfectly removed, the flange seal can produce a moisture-barrier effect over a resultant somewhat irregular surface at the container mouth.

DETAILED DESCRIPTION OF THE DRAWINGS

Figure 1:
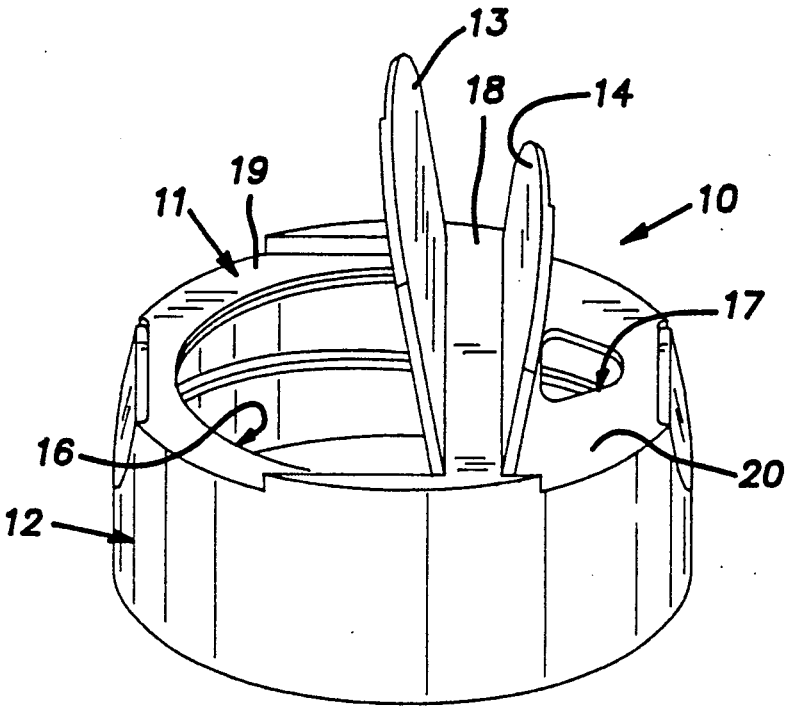
FIG. 1 is a perspective view of a screw-on two-flap cap constructed in accordance with the present invention.
Figure 2:
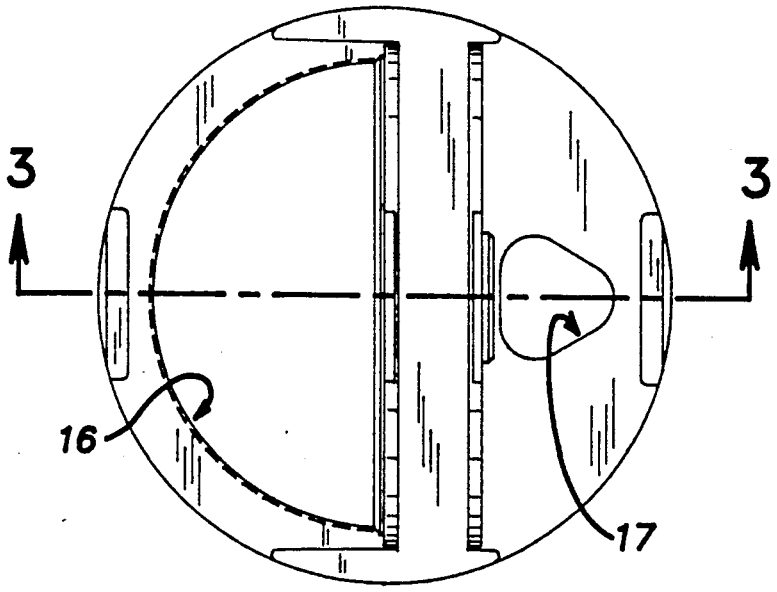
FIG. 2 is a plan view of the cap shown with the flaps in an open vertical condition.
Figure 3:
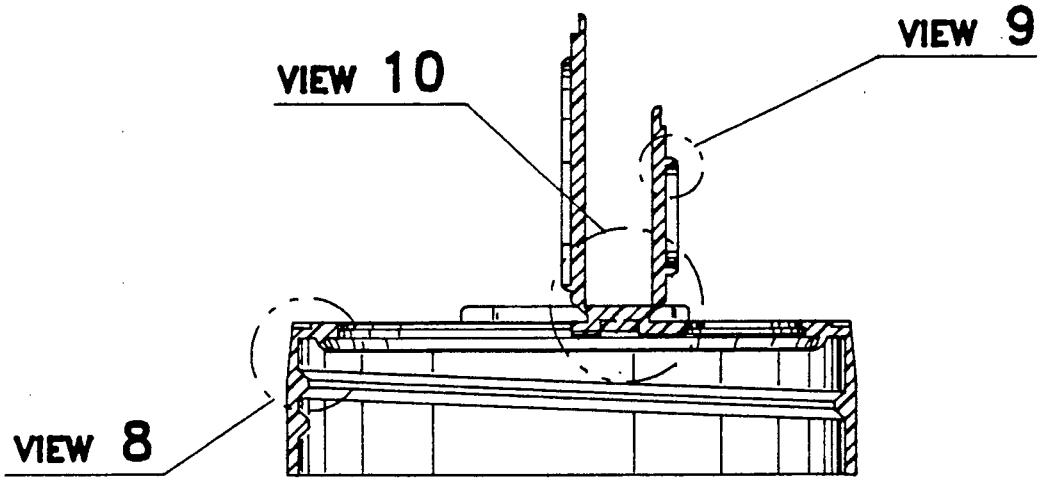
FIG. 3 is a cross-sectional elevational view taken along the plane 3—3 in FIG. 2 of the cap.
Figure 4:
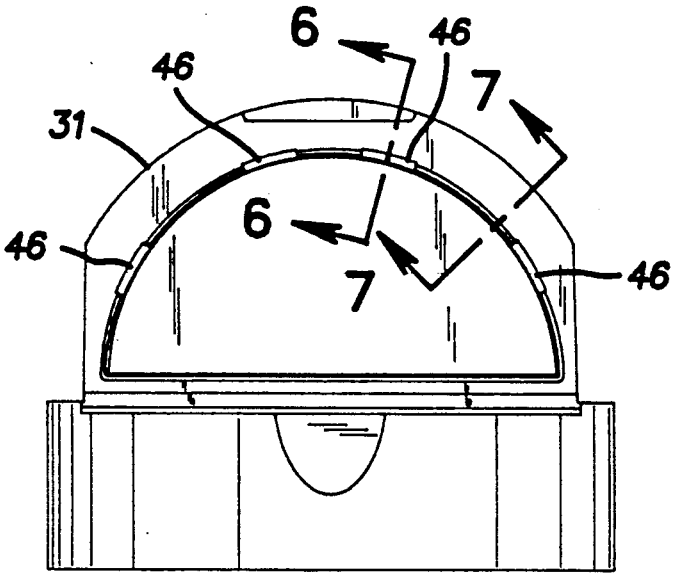
FIG. 4 is a side elevational view of the cap taken from the side of the major or spoon flap.
Figure 5:
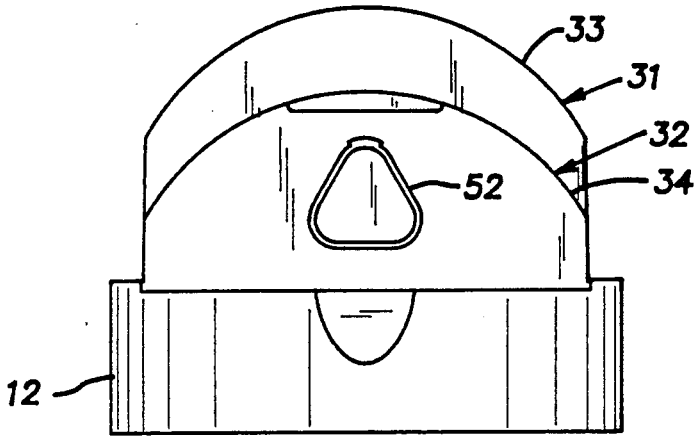
FIG. 5 is a side elevational view of the cap taken from the minor or pour flap side.

Referring now to the drawings and in particular FIGS. 1-11, there is shown a cap 10 which is preferably an injection molded product formed of suitable thermoplastic material such as polypropylene. The body of the cap 10 includes a generally circular end wall 11, a generally cylindrical skirt 12 and generally planar flaps 13, 14. In the illustrated embodiment, these elements are all molded as one piece and when the flaps 13, 14 are closed the cap 10 has the general appearance of a short solid cylinder.

Figure 11:
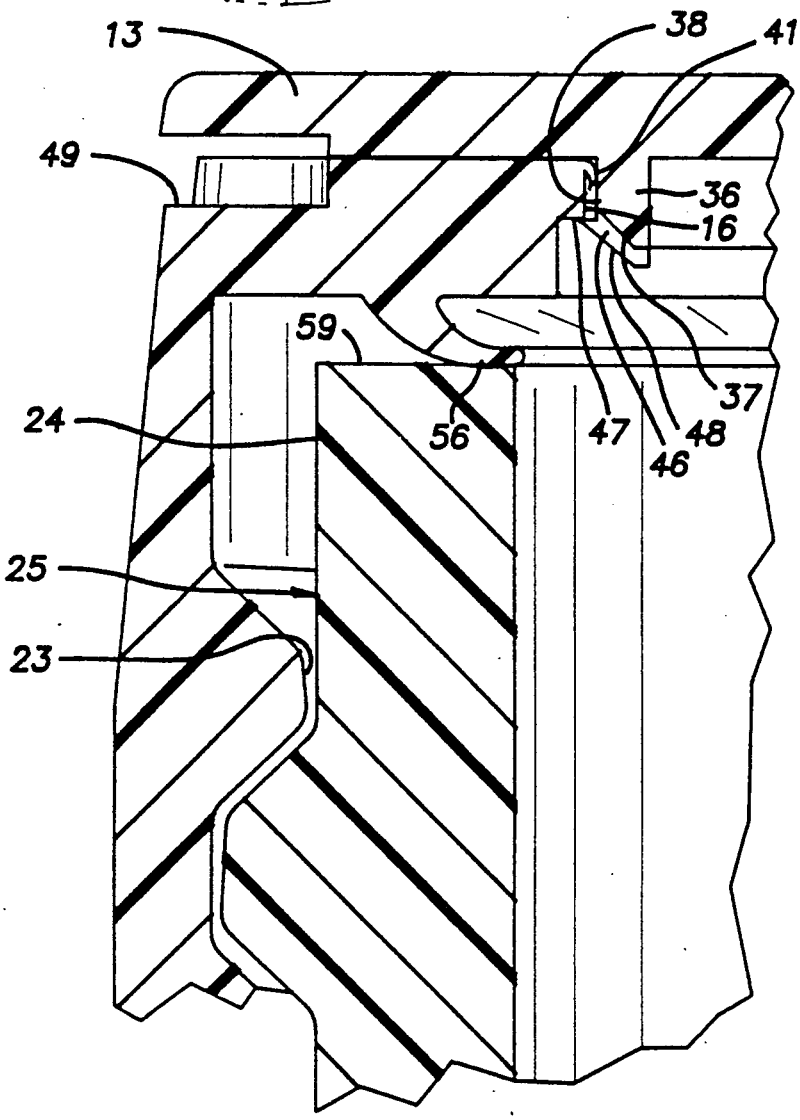
FIG. 11 is an enlarged cross-sectional view of a portion of the cap with the flap closed and installed on a container and corresponds to the section view of FIG. 8.

The end wall 11, which is substantially planar, has a spoon aperture 16 which is relatively large, preferably, occupying a D-shaped area at least about one-half of the container mouth area sealed by the cap 10 to facilitate passage and manipulation of a spoon therethrough. The end wall 11 also has another smaller triangular aperture 17 for allowing contents to be poured therethrough from a container. The end wall 11 has a nominal thickness of, for example, 0.055 inch in a central or chordal region 18 and preferably at least 0.030 inch in areas 19, 20 that surround the spoon and pour apertures 13, 14.

the cylindrical hollow skirt 12 has an internal continuous thread 23 enabling it to be screwed onto external threads on the neck 24 of a container 25 as indicated in FIG. 11. the skirt 12 is integrally joined at its upper end to the end wall 11 and has a nominal wall thickness of, for example, 0.050 inch. The flaps 13, 14 are attached to the end wall 11 by respective hinges 26, 27, sometimes called living hinges. The hinges 26, 27 are each integral with respective adjacent portions of the flaps 13, 14 and the chordal end wall region 18. The hinges 26, 27 are parallel to one another and to an imaginary line which is diametral or chordal to the end wall 11.

The illustrated flaps 13, 14 are generally D-shaped in profile and have respective free edges 31, 32 that include circular arcs 33, 34 of a diameter substantially equal to the diameter of the end wall 11 and outer diameter of the skirt 12. The free edge 31, 32 of each flap 13, 14 extends from one end of its respective hinge 26, 27 to the other. The flaps 13, 14 have a nominal wall thickness of 0.055 inch.

Figure 7:
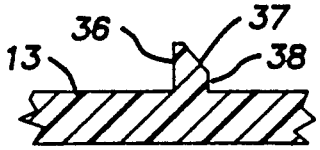
FIG. 7 is a fragmentary cross-sectional view on an enlarged scale taken in the plane 7—7 indicated in FIG. 4 of the spoon flap.
Figure 9:
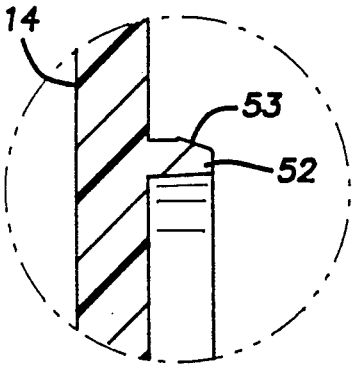
FIG. 9 is an enlarged fragmentary view of a portion of the pour flap outlined in FIG. 3.
Figure 10:
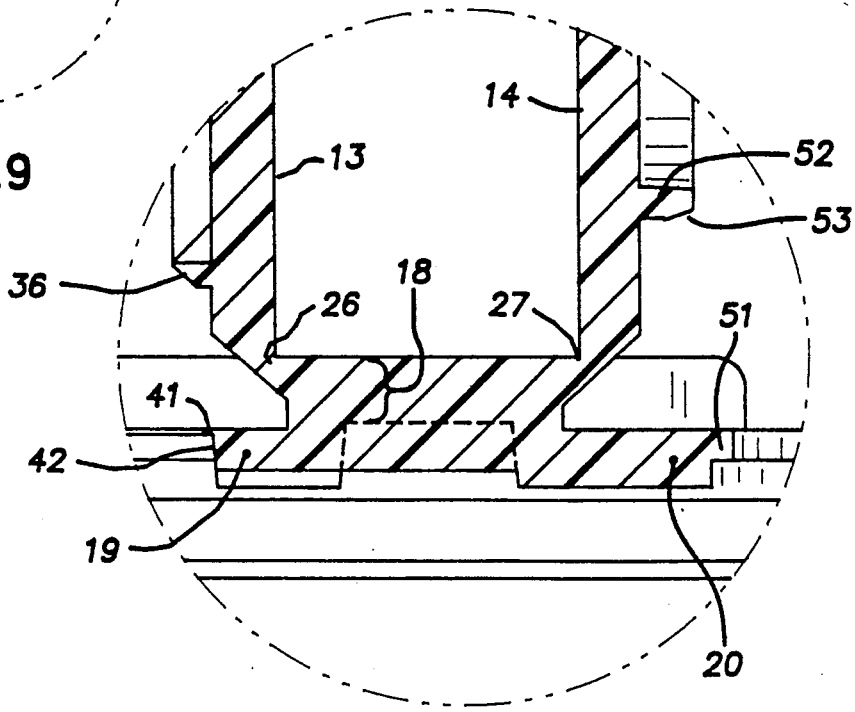
FIG. 10 is an enlarged cross-sectional view of a portion of the cap outline in FIG. 3.

The spoon flap 13 has a depending lip 36 that is spaced inwardly from the free edge 31 and from the hinge 26 so as to form a continuous line around the boundary of the flap. With reference to FIG. 7, a lower edge 37 of the lip 36 is beveled inwardly and an upper portion 38 of the lip presents a surface that is perpendicular to the plan of the flap 13. In the illustrated example, the total depending length of the lip 36 combining the bevelled portion 37 and the perpendicular portion 38 is approximately equal to the thickness of the flap 13.

Figure 8:
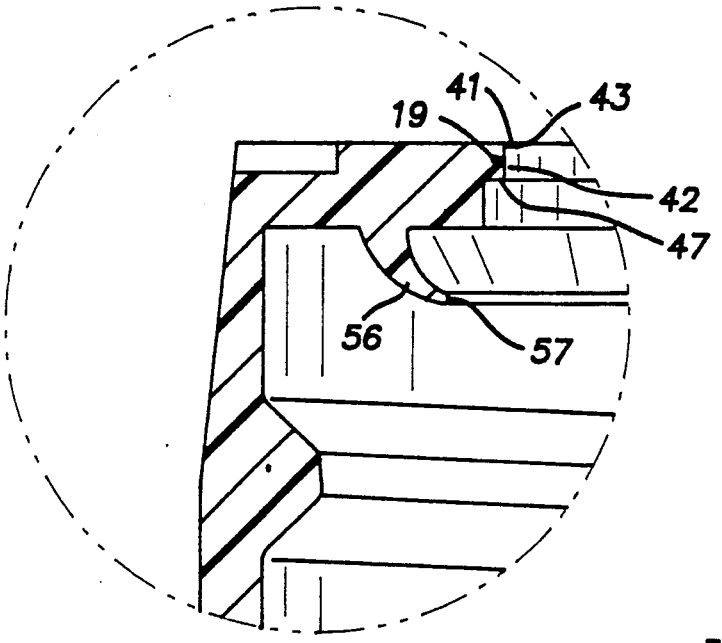
FIG. 8 is an enlarged fragmentary sectional view of an area of the cap outlined in FIG. 3.

With reference to FIG. 8, a sealing flash 41 extends continuously about the full boundary edge 42 of the spoon aperture 16. This sealing flash 41 is integrally formed on the end wall 11 and in its molded free state lies in a plane parallel to the adjacent arcuate area 19 of the end wall 11 and has its upper surface planar with the upper surface of this adjacent end wall area. The sealing flash 41 is relatively thin in the vertical direction, i.e. in the axial direction of the skirt 12. For example, the flash 41 can have a nominal vertical thickness of 0.005 to 0.010 inch. The mould cavity in which the cap 10 is formed can be arranged in local areas to provide a nominal thickness for the sealing flash 41 of as much as 0.010 inch to ensure that a complete fill of material will flow into such areas where they are remote from the gate of the mold. However, it is preferable to keep the sealing flash as thin as possible while still maintaining sufficient material flow to ensure tha the sealing flash will be fully developed in all related cavity areas. By comparison, the end wall 11 has a minimum thickness of 0.030 inch in the adjacent arcuate area 19 and a thickness of 0.055 inch at the intermediate chordal area 18 as previously mentioned. The illustrated sealing flash 41 has a cantilevered length in the horizontal direction of about 0.010 inch, for example.

In its plane parallel to the flap 13, the lip 36 has a boundary or profile that is larger than the area bounded by the continuous free edge, designated 43, of the sealing flash 41. As indicated in FIG. 11, when the spoon flap 13 is closed, the lip 36 projects into the aperture 16 and is engaged by the sealing flash 41. The sealing flash 41 is resiliently stressed by bending inwardly to accommodate the oversize flap lip 36. In the fully closed position of the flap 13, the stressed, bent-over sealing flash 41 engages the lip portion 38 perpendicular to the flap. Upon closing of the flap 13, the bevelled lip portion 37 facilitates entry of the lip 36 into the sealing flash 41 with a wedging action. From FIG. 11, it can be seen that the flap lip 36 is tightly engaged by the sealing flash 41 and a moisture-resistant barrier is provided at the zone of this contact. Any minor misalignments between the flap 13 and aperture 16 due to manufacturing variation are taken up by more or less compliant bending in the sealing flash 41. by being bent downwardly or inwardly towards the interior of a container, the sealing flash 41 is capable of increasing its sealing force in proportion to the pressure developed inside the container. The various parts of the cap can be dimensioned with tolerances so that the sealing flash 41 in the most loose condition at least engages the lip 36 with a snug compressive fit without bending of the lip.

Figure 6:
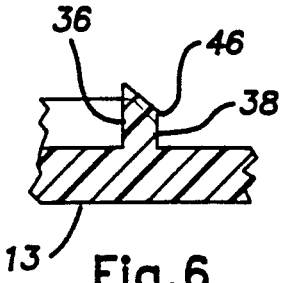
FIG. 6 is a fragmentary cross-sectional view on an enlarged scale taken in the plane 6—6 indicated in FIG. 4 of a portion of the spoon flap.

A plurality of hooks 46 illustrated in FIg. 6 are arcuately spaced about the lip 36 and are dimensioned to slip under a lower face 47 of the end wall area 19 to releasably retain the flap 13 in a closed position. On closing of the flap 13, an oblique face 48 of each catch or hook 46, after deflecting the sealing flash 41, causes sufficient resilient local deflection in the lip or rib 36 to allow the catch or hook 46 to pass through the aperture 16 and grip the face 47. A manual force applied by a thumb or fingernail to the underside of the flap at a relief area 49 in the skirt 12 is sufficient to release the catches 46 and open the flap 13.

The triangular pour aperture 17 is substantially smaller than the spoon aperture 16 and is surrounded by considerably more plastic stock in the area 20 than is the spoon aperture 16. As a consequence, the pour aperture can be held to a more uniform size and shape than the spoon aperture 16. A resilient bendable sealing flash like the sealing flash 41 can be provided at this aperture if necessary. As shown, a reduced wall thickness flange 51 is provided at the periphery of the aperture 17 to provide a high sealing pressure against a depending triangular lip 52 on the underside of the flap 14. A catch or hook 53 on the lip 52 is dimensioned to slip under this flange 51 to releasably retain the flap in a closed position.

As partially shown in FIG. 8, a circumferentially continuous resilient sealing flange 56 if formed on the underside of the end wall 11 radially inward of the juncture between the end wall 11 and skirt 12. The sealing flange extends from a point where it is integral with the end wall 11 axially downwardly and radially inwardly to a free edge 57. For example, in the free molded state of the sealing flange, the free edge extends a distance of approximately 0.070 inch radially from its radially outermost point where it is joined to the end wall 11 and extends axially downwardly from the end wall approximately 0.050 inch. the dimensions given herein are for a nominal cap diameter size of 63 mm. As indicated in FIG. 11, the sealing flange 56 is arranged to engage the end face 59 of the mouth of a container and upon tightening of the cap 10 on the container the sealing flange resiliently deflects axially towards the end wall 11 to produce a compliant and reliable seal. The resilient deflection of the sealing flange 56 assures that a moisture-resistant seal is effected against the container end face regardless of manufacturing variations in the cap and/or container 25. Similarly, the sealing flange 56 is adapted by its resilience to accommodate any irregularities at the end face 59 which might be produced by an imperfect stripping away of a sealing or tamper-indicating liner applied to the end face after filling of the container.

Figure 12:
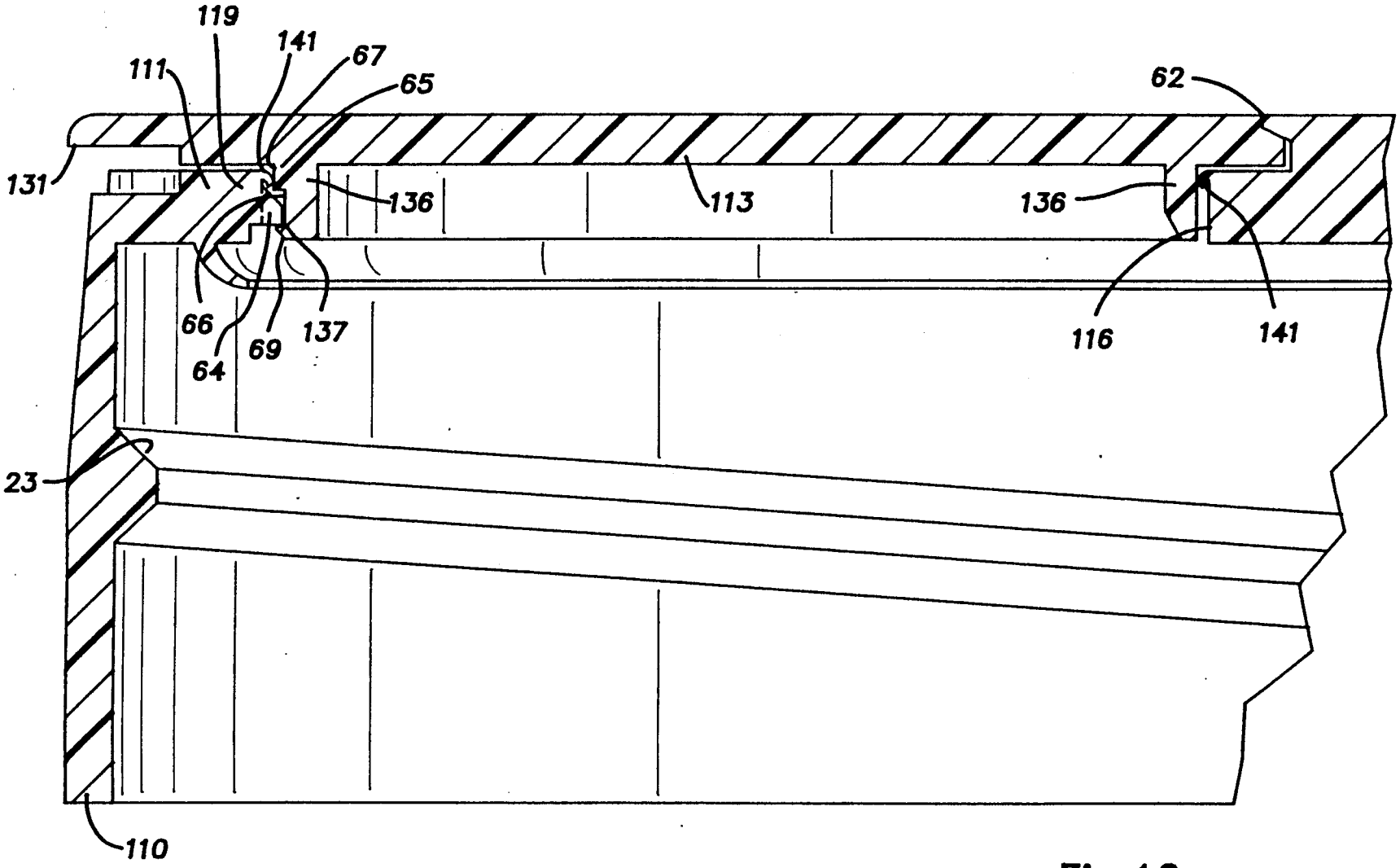
FIG. 12 is an enlarged cross-sectional view of a second embodiment of a cap constructed in accordance with the invention.

FIG. 12, which is analogous to FIG. 8, illustrates a second embodiment of the invention. Parts of a cap 110 illustrated in this FIG. 12 corresponding with parts of the cap 10 of FIGS. 1-11 are designated with the same number preceded by the number 1. The cap 110 includes an integrally hinged spoon flap 113 for closing a spoon aperture 116. The flap 113 has a depending lip or skirt 136 that is continuous along the full boundary of the flap including both its free edge 131 and its hinged edge 62. Leading portions 137 of the lip 136 are bevelled to facilitate closure of the flap 113. The spoon aperture 116 is formed with a sealing flash 141 equivalent in structure and function to the sealing flash 41 described in connection with the cap 10. Beneath the sealing flash 141 on the part 119 of the end wall 111 that the free edge 131 of the flap 113 overlies are a series of arcuately spaced lugs or projections 64 that lie slightly in the path of the lip 136 as the flap 113 is closed. The lugs 64 can be circumferentially spaced on the end wall 111, for example, in the same general pattern as the hooks 46 (FIG. 4) are spaced on the flap 13. Each lug 64 projects slightly radially inward of the sealing flash 141 when the sealing flash is in its free state as indicated in phantom at 65 in FIG. 12. A peripheral groove 66 in a lip face 67 perpendicular to the plane of the flap 113 is adapted to receive the lugs 64 as an adjacent peripheral flange catch area 69 snaps below the lugs 64 to releasably retain the flap 113 in a closed position. The sealing flash 141 is preferably dimensioned to interfere slightly with the lip face 67 that is perpendicular to the plane of the flap 113 so that it is resiliently deflected or bent downwardly and compliantly engages this lip face to provide moisture-resistant engagement therewith around the full periphery of the lip 136. The arrangement of the lip 136 and lugs 64 illustrated in FIG. 12 reduces or eliminates permanent distortion of the sealing flash 141 by avoiding or reducing the amount of deflection required of the sealing flash to permit closing and opening movement of the circumferential catch 69 of the lip 136.

While the invention has been shown and described with respect to particular embodiments thereof, this is for the purpose of illustration rather than limitation, and other variations and modifications of the specific embodiments herein shown and described will be apparent to those skilled in teh art all within the intended spirit and scope of the invention. For example, the hinged flap and sealing flash can be incorporated on other non-screw on types of container closures or caps such as those that snap or are glued on or in a container mouth. Accordingly, the patent is not to be limited in scope and effect to the specific embodiments herein shown and escribed nor in any other way that is inconsistent with the extent to which the progress in the art has been advanced by the invention.

What is claimed is:

1. A dispensing cap for a container comprising an injection-molded one-piece body, the body having a generally circular end wall and a generally cylindrical skirt, an aperture in the end wall of a size sufficient to allow spooning out granular product from the container through the aperture, a generally planar flap closing the aperture, the flap being hinged on the end wall along a line generally parallel to a diametral line across the end wall between an open position clear of the aperture and a closed position over the aperture, the flap lying in a plane substantially parallel to the end wall when its closed position over the aperture; major areas of the skirt, end wall and flap each having a nominal wall thickness, a sealing flash extending around the aperture, the sealing flash having a thickness that is a minor fraction of the nominal wall thickness of any of the skirt, end wall and flap and a free length sufficient in comparison to its thickness to enable it to bend, the sealing flash having an interference fit between the end wall and the flap when the flap is in the closed position and being arranged to elastically deform in local bending deflection to accommodate closing of the flap and produce a resilient seal between the end wall and the flap.

2. A cap as set forth in claim 1, wherein said sealing flash in a sealing position is arranged to increase its sealing force in proportion to an increase in pressure in the container.

3. A cap as set forth in claim 1, wherein the sealing flash is formed on the end wall.

4. A cap as set forth in claim 1, wherein said sealing flash is molded in a condition wherein it has a cantilevered length greater than its thickness.

5. A cap as set forth in claim 4, wherein the sealing flash is molded in a generally flat plane.

6. A cap as set forth in claim 5, wherein the end wall and the sealing flash have upper faces that are molded in a substantially coplaner configuration.

7. A cap as set forth in claim 1, wherein said flap includes a depending lip and said sealing flash is arranged to seal against said lip when said flap is closed.

8. A cap as set forth in claim 7, wherein said flap has a continuous free edge extending substantially from one end of the hinge to the other, said lip extending continuously on a line spaced inwardly from one free edge.

9. A cap as set forth in claim 8, wherein said lip provides a seating surface substantially perpendicular to the plane of the flap, said sealing flash being arranged to sealingly engage said seating surface.

10. A cap as set forth in claim 9, wherein sais lip includes a portion adjacent said hinge that with remaining portions of said lip defines a closed boundary for said opening.

11. A cap as set forth in claim 1, including a resilient sealing flange integrally formed therewith, the sealing flange being adapted to sealingly and resiliently engage the mouth of a container.

* * * * *